US007706560B2

(12) United States Patent
Takayama et al.

(10) Patent No.: US 7,706,560 B2
(45) Date of Patent: Apr. 27, 2010

(54) SPEAKER APPARATUS

(75) Inventors: Koji Takayama, Yamagata (JP); Hiroyuki Kobayashi, Yamagata (JP); Shinichi Hayasaka, Yamagata (JP); Kazuki Yuze, Yamagata (JP)

(73) Assignees: Pioneer Corporation, Tokyo (JP); Tohoku Pioneer Electronic Corporation, Yamagata (JP)

( * ) Notice: Subject to any disclaimer, the term of this patent is extended or adjusted under 35 U.S.C. 154(b) by 1218 days.

(21) Appl. No.: 11/258,055

(22) Filed: Oct. 26, 2005

(65) Prior Publication Data

US 2006/0088182 A1 Apr. 27, 2006

(30) Foreign Application Priority Data

Oct. 27, 2004 (JP) ..... P2004-312726
Oct. 27, 2004 (JP) ..... P2004-312727

(51) Int. Cl.
*H04R 25/00* (2006.01)

(52) U.S. Cl. ..... 381/396; 381/398; 381/404

(58) Field of Classification Search ..... 381/396, 381/398, 400, 404, 407–408, 423–424
See application file for complete search history.

(56) References Cited

U.S. PATENT DOCUMENTS 5,619,019 A 4/1997 Yoshimura et al.
6,449,375 B1 9/2002 Hutt
2003/0079936 A1 5/2003 Kuze et al.

FOREIGN PATENT DOCUMENTS

| | | | |
|---|---|---|---|
| DE | 39 29 601 | A1 | 3/1991 |
| JP | 53-036097 | A1 | 9/1978 |
| JP | 63-041995 | U | 3/1988 |
| JP | 7-7790 | A | 1/1995 |
| JP | 9-37387 | A | 2/1997 |
| JP | 9-107597 | A | 4/1997 |
| JP | 11-187481 | A | 7/1999 |
| JP | 2001-245385 | A | 9/2001 |
| JP | 2003-37893 | A | 2/2003 |
| WO | 2004/004410 | A1 | 1/2004 |

OTHER PUBLICATIONS

Japanese Office Action mailed Jul. 14, 2009.

*Primary Examiner*—Suhan Ni
(74) *Attorney, Agent, or Firm*—Sughrue Mion, PLLC

(57) ABSTRACT

A cross-sectionally substantially-semicircular portion of an edge portion adapted to connect an outer periphery of a diaphragm to a speaker frame is configured to have an uneven-thickness structure in which the thickness of the portion gradually decreases toward a sticking portion of an outer peripheral portion of the speaker frame from a sticking portion of the outer periphery of the diaphragm. Thus, the propagation characteristic of vibrations generated on the edge portion is improved. Disturbance is prevented from occurring in an mid-range frequency characteristic due to inverse resonance caused by the edge portion.

3 Claims, 3 Drawing Sheets

SPEAKER APPARATUS

BACKGROUND OF THE INVENTION

1. Field of the Invention

The present invention relates to a speaker apparatus in which an outer periphery of a diaphragm is supported by a speaker frame through a cross-sectionally semicircular edge portion and in which an inner periphery of the diaphragm is supported by the speaker frame through what is called a corrugation damper.

2. Description of the Related Art

FIG. 1 is a longitudinally cross-sectional view illustrating a related speaker apparatus.

This speaker apparatus 1 has a magnetic circuit 3, a speaker frame 5 having a rear portion to which this magnetic circuit 3 is attached, a cone diaphragm 7 having an outer periphery to which a cross-sectionally substantially-semicircular edge portion 9 is continuously provided, a cylindrical voice coil bobbin 11 attached to an inner peripheral edge of the diaphragm 7, and a voice coil 12 wound around this voice coil bobbin 11.

The magnetic circuit 3 consists of a yoke 15 in which a cylindrical center pole 15*b* is provided on a disk-like plate 15*a* to protrude therefrom, a ring-like magnet 16 loosely fitted to an outer periphery of the center pole 15*b*, and a ring-like top plate 17 loosely fitted to a front end side of the center pole 15 to sandwich the magnet 16 between the plate 25*a* and the top plate 17. The top plate 17 is fixed to a rear end of the speaker frames.

In this magnetic circuit 3, the gap between the inner periphery of the top plate 17 and the center pole 15*b* is a magnetic gap in which the voice coil 12 is disposed.

The voice coil bobbin 11 fixed to the inner peripheral edge of the diaphragm 7 is connected to the speaker frame 5 through the corrugation damper 19 of a structure in which ridge and groove portions are alternately and coaxially arranged along a radial direction, thereby being hung movably in the direction of an axis of the center pole 15*b*.

A mounting flange portion 9*a* extended from the outer peripheral rim of the outer peripheral edge member 9 connected to the diaphragm 7 is stuck to an outer peripheral portion 5*a* of the speaker frame 5. Thus, the diaphragm 7 is displaceably supported by the edge member 9.

That is, the diaphragm 7 has an outer peripheral portion connected to the outer peripheral portion 5*a* of the speaker frame 5 through the edge member 9, and also has an inner peripheral portion connected to the speaker frame 5 through a corrugation damper 19. Thus, the diaphragm 7 is elastically supported to be able to displace back and front.

It has turned out that in this speaker apparatus, the insurance of amplitude symmetry, that is, the equalization of forward and backward amplitudes of the diaphragm 7 is a major factor of suppressing occurrence of distortion of speaker sound to thereby improve sound quality.

Thus, hitherto, to ensure the amplitude symmetry, the stiffness of the edge member 9, which supports the diaphragm, and that of the corrugation damper 19 are adjusted by conditioning materials to be used.

Incidentally, in the related apparatus, usually, the edge member 9 has a cross-sectional structure in which the thickness of a cross-sectionally substantially-semicircular part thereof is uniform. However, an edge member, which is configured to have a laminated structure made of different kinds of materials to thereby obtain desired stiffness, has been proposed (See, for example JP-A-11-187481).

Further, the corrugation damper 19 is usually set, as shown in FIG. 2. That is, a bending radius $R_y$ of the top part of the ridge portion and a bending radius $R_t$ of the top part of the groove portion satisfy the following equation.

$$R_y=R_t.$$

Also, a corrugation height $H_y$ of the ridge portion and a corrugation depth $H_t$ of the groove portion meet the following equation.

$$H_y=H_t.$$

That is, the corrugation damper 19 is usually designed so that the ridge portion and the groove portion have symmetric shapes, respectively. However, a speaker apparatus, which is adapted to obtain desired stiffness by setting the corrugation heights, the corrugation depths and the bending radii R of the ridge and groove portions to vary with the outer periphery and the inner periphery, has been proposed (see, for instance, JP-A-2003-37893).

SUMMARY OF THE INVENTION

Meanwhile, the vibration propagation characteristic of the cross-sectionally substantially-semicircular edge portion having a uniform thickness is constant, regardless of whether the edge member has the laminated structure made of different kinds of materials. Vibrations generated due to the difference in physical property between the edge member and a diaphragm body (a cone body) easily propagate. Thus, the related apparatus employing such an edge member has a problem in that disturbance is liable to occur in a mid-range frequency characteristic due to inverse resonance. The mid-range of the frequency is about 500 Hz to 2000 Hz.

Further, the cross-sectionally substantially-semicircular edge portion having a uniform thickness tends to be easily displaced backwardly (downwardly, as viewed in FIG. 2). For example, when such an edge member is combined with a corrugation damper designed so that the corrugation damper has a uniform thickness and that the shapes of the ridge portion and the groove portion are symmetric with each other, the diaphragm has an asymmetric amplitude characteristic by which the backward amplitude of the diaphragm is larger than the forward amplitude thereof. Thus, distortion of the diaphragm, which is generated due to the asymmetrical property of the amplitude thereof, is a cause of deterioration in the sound quality.

Meanwhile, in the corrugation damper configured to set the corrugation heights, the corrugation depths and the bending radii R of the ridge and groove portions to vary with the outer periphery and the inner periphery, the vibration damping property varies with the outer periphery and the inner periphery. Thus, when such a corrugation damper is combined with the cross-sectionally substantially-semicircular edge portion having a uniform thickness, the related apparatus is expected to have an advantage in suppressing occurrence of the inverse resonance caused by the edge member. However, the shape of a forming die therefor is complicated. Thus, the related apparatus has problems in that the formability thereof is poor, and that it is difficult to obtain stable-quality products.

It is an object of the invention to provide a speaker apparatus and a corrugation damper which can improve a sound quality by equalization of the forward amplitude and the backward amplitude of the diaphragm thereof.

According to an aspect of the invention, there is provided a speaker apparatus, including: a corrugation damper having a ridge portion and a groove portion which are alternately and coaxially arranged along a radial direction thereof, respectively; a speaker form having an outer peripheral edge portion; and a diaphragm having: an outer peripheral edge portion being supported by the outer peripheral edge portion of the speaker frame thorough a cross-sectionally substantially semicircular edge portion; and an inner periphery being supported by the speaker frame through the corrugation damper. A cross-sectionally substantially-semicircular part of edge portion is configured to have an uneven-thickness structure in which a thickness thereof gradually decreases toward a sticking portion of an outer peripheral portion of the speaker frame from a sticking portion of the outer periphery of the diaphragm.

DESCRIPTION OF THE PREFERRED EMBODIMENTS

Hereinafter, an embodiment of a speaker apparatus is described in detail by referring to the accompanying drawings.

Figure 1:
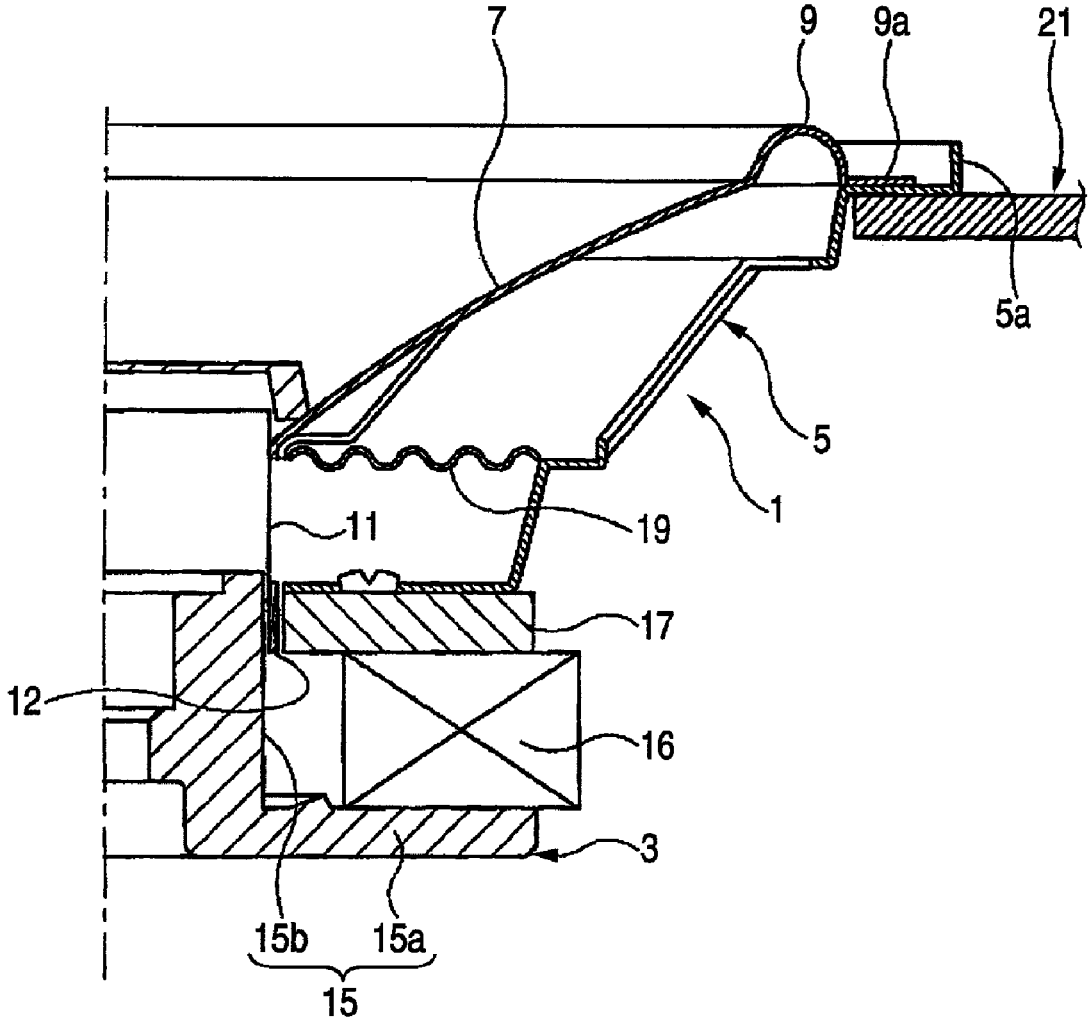
FIG. 1 RELATED ART
FIG. 1 is a longitudinally cross-sectional view illustrating a related speaker apparatus.
Figure 2:
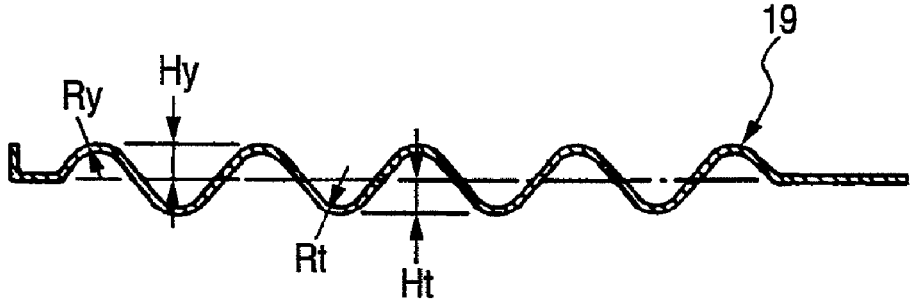
FIG. 2 RELATED ART
FIG. 2 is an enlarged cross-sectional view illustrating a corrugation damper of the speaker apparatus shown in FIG. 1.
Figure 3:
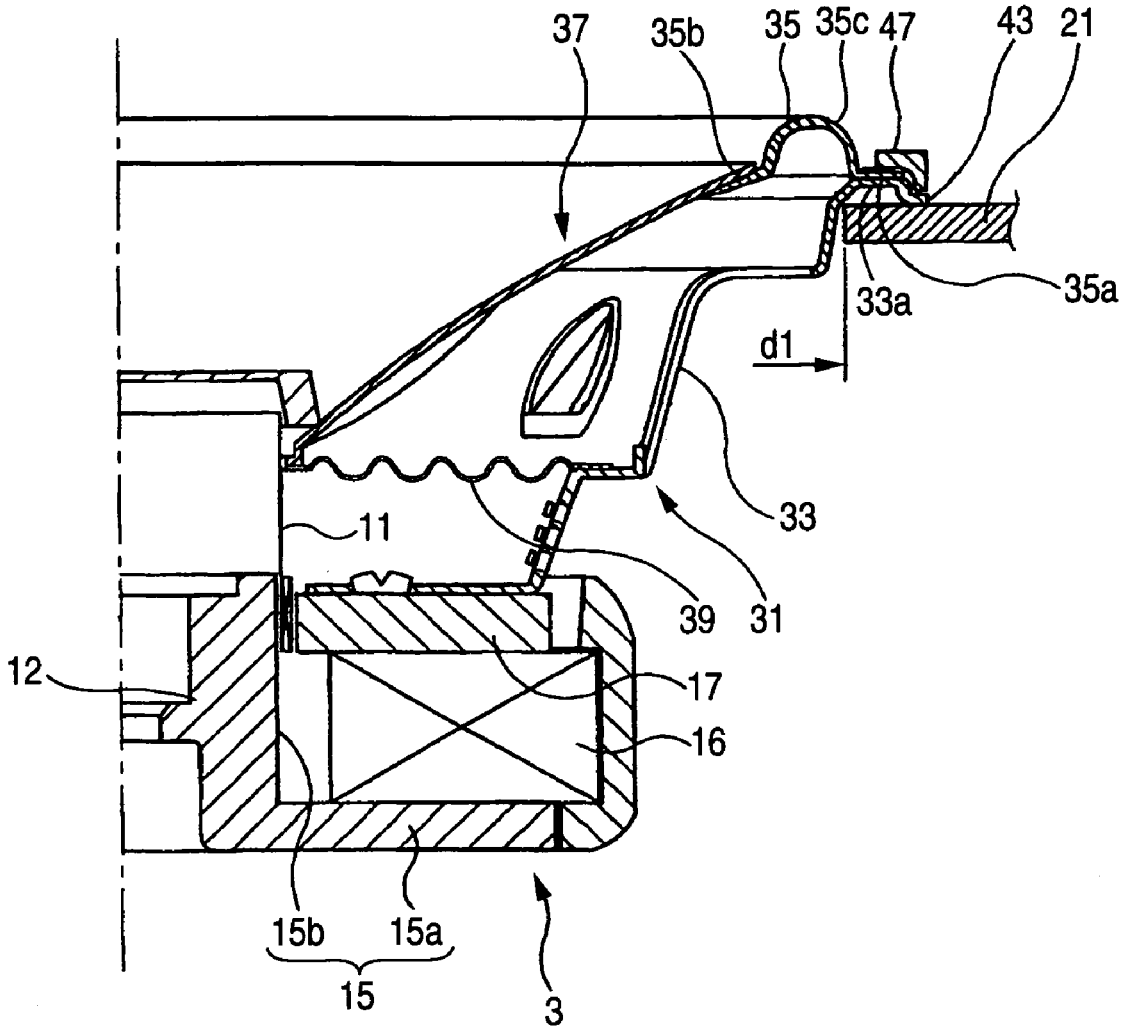
FIG. 3 is a longitudinally cross-sectional view illustrating an embodiment of a speaker apparatus.
Figure 4:
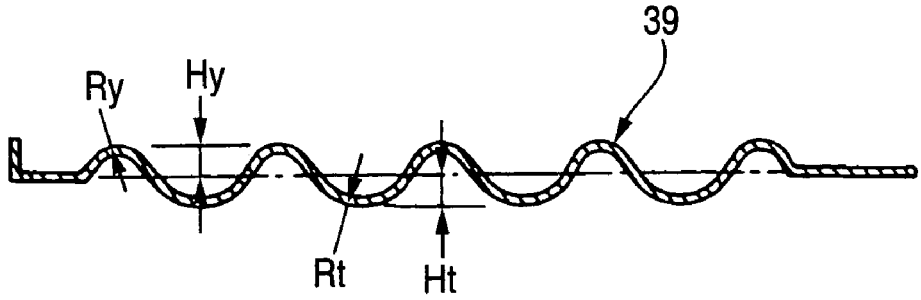
FIG. 4 is an enlarged cross-sectional view illustrating a corrugation damper of the speaker apparatus shown in FIG. 3.
Figure 5:
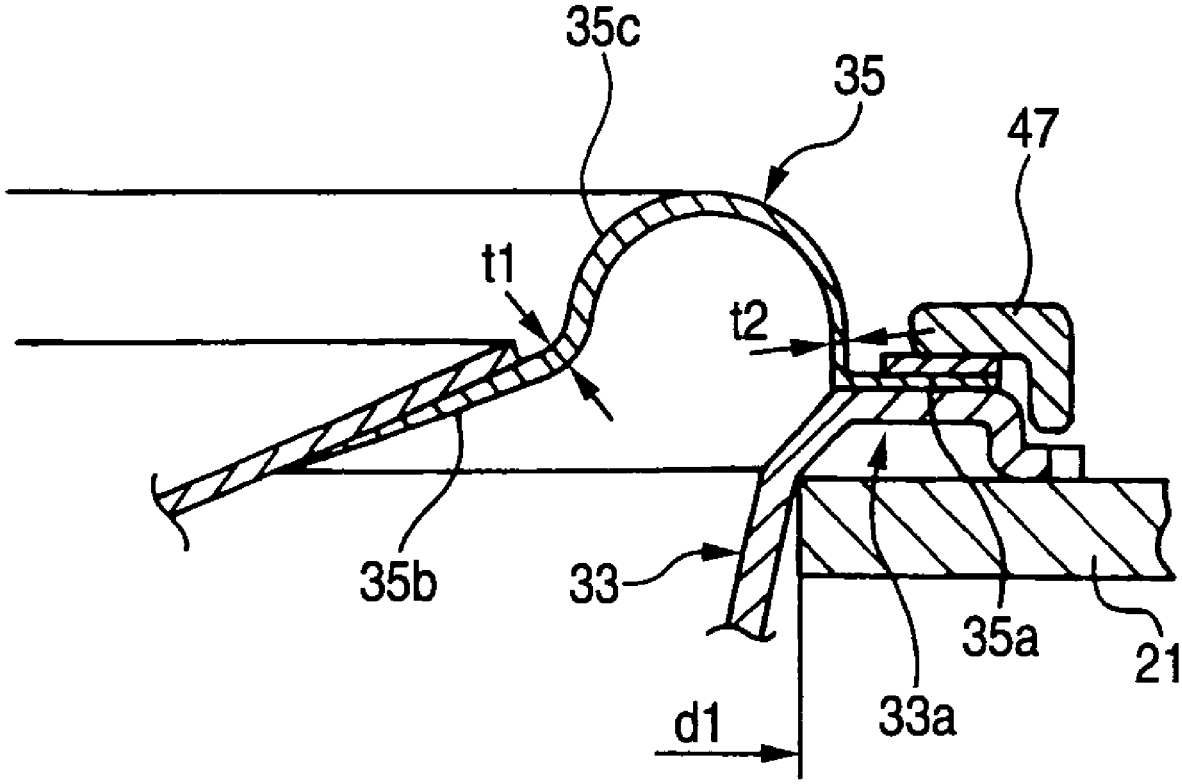
FIG. 5 is an enlarged cross-sectional view illustrating an edge member of the speaker apparatus shown in FIG. 3.

FIGS. 3 to 5 show the embodiment of the speaker apparatus. FIG. 3 is a longitudinally cross-sectional view illustrating the embodiment of the speaker apparatus. FIG. 4 is an enlarged cross-sectional view illustrating a corrugation damper of the speaker apparatus shown in FIG. 3. FIG. 5 is an enlarged cross-sectional view illustrating an edge member of the speaker apparatus shown in FIG. 3.

A speaker apparatus 31 according to the embodiment has a magnetic circuit 3, a speaker frame 33 having a rear portion to which this magnetic circuit 3 is attached, a cone diaphragm 37 having an outer periphery to which a cross-sectionally substantially-semicircular edge portion 35 is continuously provided, a cylindrical voice coil bobbin 11 attached to an inner peripheral edge of the diaphragm 37, and a voice coil 12 wound around this voice coil bobbin 11.

The magnetic circuit 3 includes a yoke 15 in which a cylindrical center pole 15*b* is provided on a disk-like plate 15*a* to protrude therefrom, a ring-like magnet 16 loosely fitted to an outer periphery of the center pole 15*b*, and a ring-like top plate 17 loosely fitted to a front end side of the center pole 15*b* to sandwich the magnet 16 between the plate 15*a* and the top plate 17. The top plate 17 is fixed to a rear end of the speaker frame 33.

In this magnetic circuit 3, the gap between the inner periphery of the top plate 17 and the center pole 15*b* is a magnetic gap in which the voice coil 12 is disposed.

The voice coil bobbin 11 fixed to the inner peripheral edge of the diaphragm 37 is connected to the speaker frame 33 through a corrugation damper 39 of a structure in which ridge and groove portions are alternately and coaxially arranged along a radial direction, thereby being hung movably in the direction of an axis of the center pole 15*b*.

As shown in FIG. 4, this corrugation damper 39 is adapted so that the bending radius $R_y$ of the top part of the ridge portion and the bending radius $R_t$ of the bottom part of the groove portion are set so that $R_y<R_t$.

Further, the corrugation height $H_y$ of the ridge portion and the corrugation depth $H_t$ of said groove portion may be set so that $H_y<H_t$.

Further, as shown in FIG. 5 the edge portion 35 is configured so that a mounting flange portion 35*a* extended from the outer peripheral rim of the edge portion 35 connected to the diaphragm 7 is stuck to an outer peripheral portion 33*a* of the speaker frame 33 extending to the outside of a speaker mounting opening diameter d1 of a speaker mounting plate 21. Moreover, the edge portion 35 is fixed to the outer peripheral portion 33*a* in a state in which the mounting flange portion 35*a* is sandwiched by the outer peripheral portion 33*a* and a resin packing 47 fixed to the outer peripheral portion 33*a*.

A flange portion 35*b* extended to the inner peripheral edge of the edge portion 35 is integrally bonded to the back surface of the diaphragm 37.

A cross-sectionally substantially-semicircular portion 35*c* of the edge portion 35 is configured to have an uneven-thickness structure in which the thickness of the portion 35*c* gradually decreases toward a sticking portion of the outer peripheral portion 33*a* of the speaker frame from a sticking portion of the outer periphery of the diaphragm, as shown in FIG. 5.

Let t1 and t2 denote the thickness of a part in the vicinity of the sticking portion of the outer periphery of the diaphragm and the thickness of a part in the vicinity of the sticking portion of the outer peripheral portion 33*a* of the frame, respectively. Thus, the thicknesses t1 and t2 are set so that t1>t2.

As described in detail above, in the speaker apparatus 31 of the embodiment, the propagation characteristic of vibrations generated on the cross-sectionally substantially-semicircular edge portion is not uniform. Vibration damping effect is exerted corresponding to various vibration frequencies according to change in the thickness. Thus, vibrations propagated from the diaphragm 37 can efficiently be damped. Also, the vibrations can be prevented from returning to the diaphragm 37 from the edge portion 35. Therefore, disturbance can be prevented from occurring in an intermediate frequency characteristic due to inverse resonance caused by the edge portion 35. Consequently, the intermediate frequency characteristic can be improved. Further, the resonance of the body, especially, the resonance of the outer peripheral portion of the body can be suppressed by the uneven-thickness edge member. Consequently, the intermediate frequency characteristic can be improved.

Further, in the speaker apparatus 31 according to the aforementioned embodiment, the shapes of the ridge portion and the groove portion are asymmetrical with each other. Thus, the speaker apparatus 31 has an amplitude characteristic, by which the damper 39 itself is easily displaced forwardly, as compared with the related damper designed so that the shapes of the ridge portion and the groove portion are symmetrical with each other.

Thus, in the case of the aforementioned configuration in which the corrugation damper 39 is combined with the cross-sectionally substantially-semicircular edge portion 35, the corrugation damper 39 cancels out the characteristic of the cross-sectionally substantially-semicircular edge portion 35, by which the edge portion 35 is easily displaced backwardly. Thus, the diaphragm 37 can ensure the amplitude symmetry. Consequently, in addition to the improvement of the intermediate frequency characteristic, the suppression of occurrence of deformation due to the amplitude asymmetry can be achieved to thereby more improve the sound quality.

Further, the forming die for the corrugation damper 39 used in the speaker apparatus 31 has only to have a structure in which similar concavities and convexities are consecutively provided. Thus, the corrugation damper 39 is advantageous in simplifying the shape of the forming die over the related corrugation damper in which the corrugation heights, the corrugation depths and the bending radii R of the ridge and groove portions to vary with the outer periphery and the inner periphery. Consequently, the formability of the corrugation damper is improved. Stable-quality products can easily be obtained. The manufacturing cost thereof can be reduced.

What is claimed is:

1. A speaker apparatus, comprising:

a corrugation damper having a ridge portion and a groove portion which are alternately and coaxially arranged along a radial direction thereof, respectively;

a speaker frame having an outer peripheral edge portion; and a diaphragm having:

an outer peripheral edge portion being supported by the outer peripheral edge portion of the speaker frame through a cross-sectionally substantially semicircular edge portion; and an inner periphery being supported by the speaker frame through the corrugation damper, wherein the outer peripheral edge portion has a cross-sectionally substantially-semicircular portion of which a thickness gradually decreases toward a sticking portion of the outer peripheral portion of the speaker frame from a sticking portion of the outer periphery of the diaphragm.

2. The speaker apparatus according to claim 1, wherein the corrugation damper is adapted so that a bending radius $R_y$ of a top portion of the ridge portion and a bending radius $R_t$ of a bottom portion of the groove portion are set so that $R_y<R_t$.

3. The speaker apparatus according to claim 2, wherein the corrugation damper is adapted so that a corrugation height $H_y$ of the ridge portion and a corrugation depth $H_t$ of the groove portion are set so that $H_y<H_t$.

* * * * *